US009121253B2

(12) United States Patent
Gregory

(10) Patent No.: US 9,121,253 B2
(45) Date of Patent: Sep. 1, 2015

(54) MILLABLE BRIDGE PLUG SYSTEM

(71) Applicant: CNPC USA Corp., Houston, TX (US)

(72) Inventor: Marvin Allen Gregory, Spring, TX (US)

(73) Assignee: CNPC USA Corp., Houston, TX (US)

( * ) Notice: Subject to any disclaimer, the term of this patent is extended or adjusted under 35 U.S.C. 154(b) by 376 days.

(21) Appl. No.: 13/720,789

(22) Filed: Dec. 19, 2012

(65) Prior Publication Data

US 2014/0166317 A1 Jun. 19, 2014

(51) Int. Cl.

| | |
|---|---|
| ***E21B 23/06*** | (2006.01) |
| ***E21B 33/129*** | (2006.01) |
| ***E21B 33/134*** | (2006.01) |
| ***E21B 33/12*** | (2006.01) |

(52) U.S. Cl.

CPC ..... *E21B 33/134* (2013.01); *E21B 33/1204* (2013.01)

(58) Field of Classification Search

None

See application file for complete search history.

(56) References Cited

U.S. PATENT DOCUMENTS

| | | | | | |
|---|---|---|---|---|---|
| 3,091,293 | A * | 5/1963 | Fry | ..... | 166/123 |
| 3,115,186 | A * | 12/1963 | Kline | ..... | 166/135 |
| 3,526,277 | A | 9/1970 | Scott | | |
| 4,862,961 | A | 9/1989 | Neff | | |
| 5,224,540 | A * | 7/1993 | Streich et al. | ..... | 166/118 |
| 5,701,959 | A * | 12/1997 | Hushbeck et al. | ..... | 166/387 |
| 6,394,180 | B1 * | 5/2002 | Berscheidt et al. | ..... | 166/193 |
| 6,796,376 | B2 | 9/2004 | Frazier | | |
| 6,896,061 | B2 * | 5/2005 | Hriscu et al. | ..... | 166/313 |
| 7,401,788 | B2 | 7/2008 | Williams et al. | | |
| 7,789,136 | B2 | 9/2010 | Turley et al. | | |
| 7,810,558 | B2 | 10/2010 | Shkurti et al. | | |
| 8,047,280 | B2 | 11/2011 | Tran et al. | | |
| 8,066,065 | B2 | 11/2011 | Buckner | | |
| 2003/0188860 | A1 * | 10/2003 | Zimmerman et al. | ..... | 166/181 |
| 2008/0190600 | A1 * | 8/2008 | Shkurti et al. | ..... | 166/134 |
| 2010/0132960 | A1 * | 6/2010 | Shkurti et al. | ..... | 166/387 |
| 2010/0181729 | A1 | 7/2010 | Slay et al. | | |
| 2014/0166283 | A1 * | 6/2014 | Gregory | ..... | 166/285 |
| 2014/0174738 | A1 * | 6/2014 | Gregory | ..... | 166/285 |

* cited by examiner

*Primary Examiner* — Kenneth L Thompson

(74) *Attorney, Agent, or Firm* — Andrew W. Chu; Craft Chu PLLC

(57) ABSTRACT

A millable bridge plug system includes a mandrel having an upper portion and a lower portion, a shearing member attached at said upper portion of the mandrel, a sealing member, ring members, cone assemblies, slip devices, and a cap member at a lower portion of the mandrel. The shear member and the cap member are modular so that one bridge plug interchangeably connects to another bridge plug. The shear members are compatible with cap members of other bridge plugs. The shear member and the cap member further include a locking mechanism for rotational engagement by protrusions on the cap member being fit into the shear member and a locking mechanism for triggering a spring loaded lock into a groove on the cap member.

18 Claims, 4 Drawing Sheets

MILLABLE BRIDGE PLUG SYSTEM

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to a downhole tool for isolating zones in a wellbore. More particularly, the present invention relates to a millable bridge plug system.

2. Description of Related Art Including Information Disclosed Under 37 CFR 1.97 and 37 CFR 1.98

A bridge plug is a downhole tool that is lowered into a wellbore. At a particular distance through the wellbore, the bridge plug is activated. The bridge plug opens and locks to seal the bridge plug to the walls of the wellbore. The bridge plug separates the wellbore into two sides. The upper portion can be cemented and tested, separate from the sealed lower portion of the wellbore. Sometimes the bridge plugs are permanent, and they seal an entire portion of the wellbore. Other times, the bridge plugs must be removed, and still other times, the bridge plugs must be removed and retrieved. These removable bridge plugs are millable or drillable, so that a drill string can grind through the bridge plug, making remnants of the destroyed bridge plug to remain at the bottom of a wellbore or to be retrieved to the surface by drilling mud flow.

Bridge plugs generally include a mandrel, a sealing member placed around the mandrel, ring members adjacent the end of the sealing member and around the mandrel, upper and lower slip devices at opposite ends of the mandrel, and respective upper and lower cone assemblies engaged to the upper and lower slip devices. FIG. 1A shows the prior art bridge plug system 10 with a mandrel 12, sealing member 14, and upper and lower slip devices 16 and 18 shown. The bridge plug is placed in the wellbore by a setting tool on a positioning assembly, such as wireline, coiled tubing or even the drill string itself. Once in position at the correct depth and orientation, the bridge plug is activated. The setting tool holds the mandrel 12 in place, while a ramming portion of the setting tool exerts pressure on the stack, which includes the sealing member 14 and the slip devices 16 and 18. The end 22 has a cap which prevents the stack from sliding off the mandrel 12, when the ramming portion of the setting tool hits the stack. Instead, the pressure of the ramming portion compresses the stack, forcing the sealing member 14 to radially extend outward to seal against the wellbore or case and to flatten to a smaller height along the mandrel. The slip devices 16 are toothed and are distended radially outward by the stack to dig into the wellbore walls, locking the sealed configuration of the stack. The lower slip device 18 holds position by the cap at the end 22, while the upper slip device 16 lowers and locks the seal of the spread sealing member 14. When the ramming portion has compressed and locked the stack, the end 20 proximal to the setting tool on the positioning assembly is sheared, separating the bridge plug from the setting tool and the positioning assembly. FIG. 1B shows the prior art bridge plug system 10 in an activated and set state. Pressure on the lower cone assembly against the lower slip device 18 at the distal end of the mandrel causes the lower slip device 16 to open and latch against the wellbore. Continuing pressure by the ram expands the sealing member 14 against the rings to form a seal against the walls of the wellbore. Pressure on the upper cone assembly causes the upper slip device 18 to also open and latch against the wellbore, setting the seal of the sealing member.

A problem of the conventional bridge plug is the stabilization of the bridge plug during removal of multiple bridge plugs. A removal assembly, such as a drill string or other wireline device, has a drill element to drill through a millable bridge plug, the bridge plug must be able to resist rotation of the drill element itself. Otherwise, a partially milled bridge plug could become lodged on the tip of the drill element of the removal assembly. These remnants of the bridge plug would be rotating along with the drill element of the removal assembly, so that these last remnants could avoid being destroyed and possibly hinder further action of the drill element on bridge plugs further down the wellbore. The remnants of the partially milled bridge plug would be a poor drill bit for milling through subsequent bridge plugs down the wellbore.

Conventional materials of the millable bridge plug, like all downhole tools, must withstand the range of wellbore conditions, including high temperatures and/or high pressures. High temperatures are generally defined as downhole temperatures generally in the range of 200-450 degrees F.; and high pressures are generally defined as downhole pressures in the range of 7,500-15,000 psi. Other conditions include pH environments, generally ranging from less than 6.0 or more than 8.0. Conventional sealing elements have evolved to withstand these wellbore conditions so as to maintain effective seals and resist degradation.

Metallic components have the durability to withstand the wellbore conditions, including high temperatures and high pressures. However, these metallic components are difficult to remove. De-activating and retrieving the bridge plug to the surface is costly and complicated. Milling metallic components takes time, and there is a substantial risk of requiring multiple drilling elements due to the metallic components wearing or damaging a drilling element of a removal assembly.

Non-metallic components are substituted for metallic components as often as possible to avoid having so much metal to be milled for removal of the bridge plug. However, these non-metallic components still must effectively seal an annulus at high temperatures and high pressures. Composite materials are known to be used to make non-metallic components of the bridge plug. These composite materials combine constituent materials to form a composite material with physical properties of each composite material. For example, a polymer or epoxy can be reinforced by a continuous fiber such as glass, carbon, or aramid. The polymer is easily millable and withstands the wellbore conditions, while the fibers also withstand the wellbore conditions and resist degradation. Resin-coated glass is another known composite material with downhole tool applications. Composite materials have different constituent materials and different ways of combining constituent materials.

It is an object of the present invention to provide an embodiment of the millable bridge plug system with modular ends.

It is another object of the present invention to provide an embodiment of the millable bridge plug system with improved stack structures, including modular ends.

It is still another object of the present invention to provide an embodiment of the millable bridge plug system with modular ends having locking connections.

It is yet another object of the present invention to provide an embodiment of the millable bridge plug system with a modular ends for locking connection to adjacent bridge plug systems.

These and other objectives and advantages of the present invention will become apparent from a reading of the attached specifications and appended claims.

SUMMARY OF THE INVENTION

A millable bridge plug system comprises a mandrel having an upper portion and a lower portion, a shearing means attached at the upper portion of the mandrel, a sealing means positioned around the mandrel between the upper portion and the lower portion, a plurality of ring members, a plurality of cone assemblies, a plurality of slip means for extending radially outward and engaging an inner surface of a surrounding borehole, and a cap means attached at the lower portion of the mandrel. A first ring member is placed adjacent the upper end of the sealing means, and a second ring member is adjacent the lower end of the sealing means. A first cone assembly is proximate to the first ring member, and a second cone assembly is proximate to the second ring member. The slip means extend radially outward and engage an inner surface of a surrounding borehole to lock the position of the bridge plug. A first slip means is mounted around the mandrel and engages the first cone assembly, and a second slip means is mounted around the mandrel and engages the second cone assembly.

The bridge plug system is modular so that the bridge plugs are interchangeable and compatible with connecting to each other end to end. The shearing means on the upper portion of the mandrel and the cap means on the lower portion of the mandrel can engage complementary components on adjacent bridge plugs. The shearing means has a shaft member and a top locking ring. The cap means is comprised of a bottom locking ring. In one embodiment, the top locking ring comprises an outer housing and an inner housing adjacent the outer housing, and the bottom locking ring has a plurality of protrusions. The bottom locking ring with protrusions must be aligned in a particular orientation to insert through the outer housing and into the inner housing. The bottom locking ring with protrusions is rotated within the inner housing, such that the outer housing forms a locking shoulder to hold the cap means and shearing means together. In another embodiment, the shaft member of the shearing means has a locking groove, and the bottom locking ring has a groove locking means in an interior of the bottom locking ring. The shaft member can be inserted into a bottom locking ring of an adjacent bridge plug to align the locking groove and a groove locking means, such as a spring loaded piston. Once aligned, the groove locking means can trigger to spring the piston into the locking groove, holding the cap means and shearing means together. The cap means and shearing means are modular, such that the cap means of one bridge plug can lock to any shearing means of another bridge plug, and the shearing means of one bridge plug can lock to any cap means of another bridge plug.

The method of connecting two bridge plugs includes aligning a primary bridge plug and a secondary bridge plug, the secondary bridge plug being positioned below the primary bridge plug. The primary bridge plug comprises a primary mandrel having an upper portion and a lower portion, a primary shearing means attached at the upper portion of the primary mandrel, and a primary cap means attached at the lower portion of the primary mandrel. The secondary bridge plug comprises a secondary mandrel having an upper portion and a lower portion, a secondary shearing means attached at the upper portion of the secondary mandrel, and a secondary cap means attached at the lower portion of the secondary mandrel. The secondary shearing means is positioned relative to the primary cap means. The method further includes locking the secondary shearing means into the primary cap means. The locking comprises inserting the aligned primary cap means into the secondary shearing means and then rotating the primary cap means to lock in the secondary shearing means or triggering a locking means to hold the bridge plugs together. The structures are modular and interchangeable with other respective bridge plug parts.

DETAILED DESCRIPTION OF THE DRAWINGS

Figure 4:
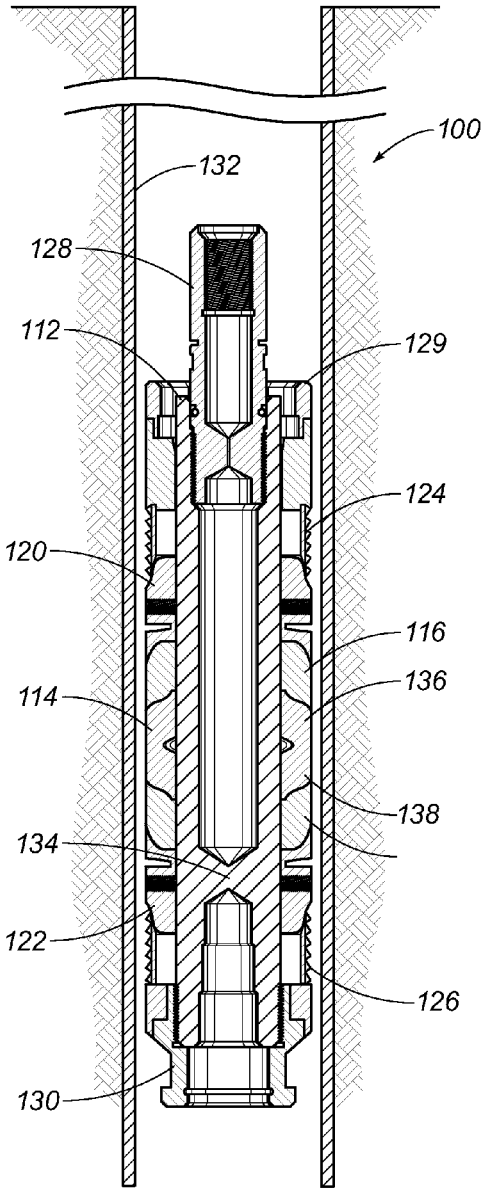
FIG. 4 is a cross-sectional view of an embodiment of the bridge plug of the present invention along an axis of the bridge plug, showing placement in the wellbore.

Referring to FIGS. 2-5, an embodiment of the millable bridge plug system 100 of the present invention is shown. The system 100 includes a mandrel 112, a sealing means 114, and a plurality of ring members, 116, 118, a plurality of cone assemblies 120, 122, and a plurality of slip means 124, 126. The sealing means 114, ring members 116, 118, cone assemblies 120, 122 and the slip means 124, 126 are stack structures mounted on the mandrel 112, sharing a common radial axis of alignment. FIGS. 2-5 also show a shearing means 128 and a cap means 130. The millable bridge plug system 100 is placed within a wellbore or borehole of a well by a setting tool. The wellbore or the borehole could have a casing or not, and the orientation of the wellbore is variable. FIG. 4 shows an embodiment with a casing 132. The bridge plug system 100 can be used in all ranges from generally vertical to generally horizontal orientations. As previously described, the millable bridge plug system 100 is used to isolate zones within the wellbore, separating sections of the wellbore for production or isolation. The system 100 is millable or drillable, such that a removal assembly, such as a drill string, can be used to grind through the system 100. All of the components of the system 100 are destroyed so that the isolated zone of the wellbore is removed.

Figure 5:
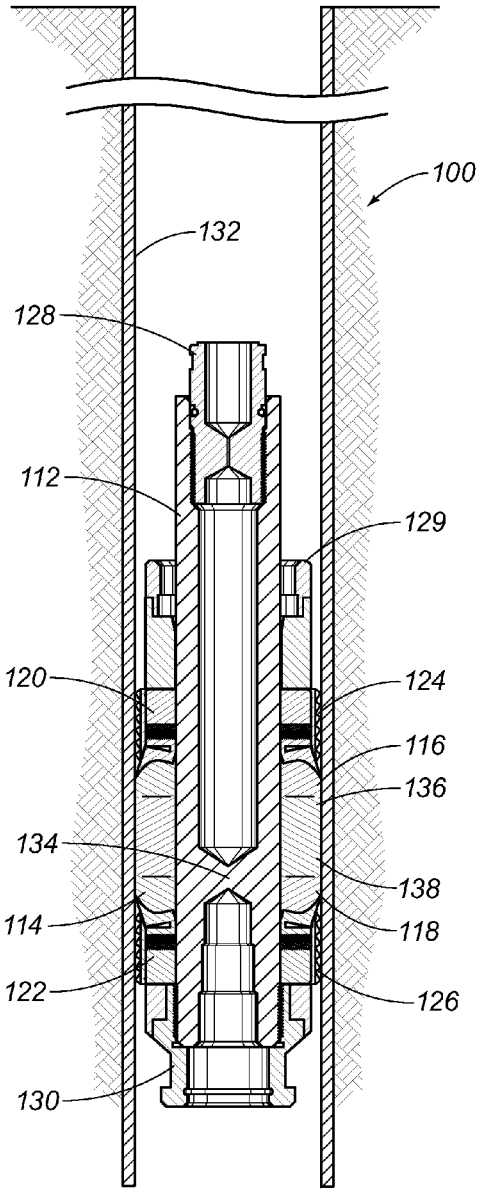
FIG. 5 is a cross-sectional view of an embodiment of the bridge plug of the present invention along an axis of the bridge plug, showing an activated configuration in the wellbore.

The mandrel 112 of the system 100 is a generally tubular member formed of a material to withstand the heat and pressure of the borehole conditions. The mandrel 112 is also millable. The mandrel 112 may have a bridge 134, which seals the zone above the system 100 from the zone below the system 100. The sealing means 114 is positioned around the mandrel 112. The sealing means 114 has an upper end 136 and lower end 138 as shown in FIGS. 4 and 5. The sealing means 114 is generally symmetrical to start and is comprised of a deformable material.

FIGS. 2-5 also show the plurality of ring members, 116, 118. There is a first ring member 116 adjacent the upper end 136 of the sealing means 114 and a second ring member 118 adjacent the lower end 138 of the sealing means 114. The ring members 116, 118 surround the sealing means 114 and surround the mandrel 112. The ring members 116, 118 contact the sealing means 114 and can exert pressure on the sealing means 114. In an activated state, the system 100 has the sealing means 114 compressed to radially extend to contact the wellbore or casing 132. The ring members 116, 118 directly contact the sealing means 114. The seal created by the sealing means 114 isolates the zones on the wellbore. In combination with the bridge 130 in the mandrel 112, the wellbore is separated.

The system 100 also includes the plurality of cone assemblies, 120, 122. FIGS. 2-5 show a first cone assembly 120 proximate to the first ring member 116 and a second cone assembly 122 proximate to the second ring member 118. As shown in exploded view of FIG. 3, the first ring member 116 is mounted on the mandrel 112 between the first cone assembly 120 and the sealing means 114. Similarly, the second ring member 118 is mounted on the mandrel 112 between the second cone assembly 122 and the sealing means 114. The cone assemblies 120, 122 contact the ring members 116, 118 and can exert pressure on the ring members 116, 18. In an activated state, the system 100 has pressure of the cone assemblies 120, 122 pushing through the ring members 116, 118 to the sealing means 114.

FIGS. 2-5 also show the plurality of slip means 124, 126 for extending radially outward and engaging an inner surface of a surrounding borehole. The slip means 124, 126 lock the position of the system 100 by fixedly engaging the casing 132 or other structure on the inner surface of the borehole. The slips dig into the casing 132 to anchor the millable bridge plug system 100. Pressure can be exerted on the system 100 to create the seal with the sealing means 114, once the slip means 124, 126 are active. There is a first slip means 124 mounted around the mandrel 112 and engaging the first cone assembly 120 and a second slip means 126 mounted around the mandrel 112 and engaging the second cone assembly 122.

Figure 1A:
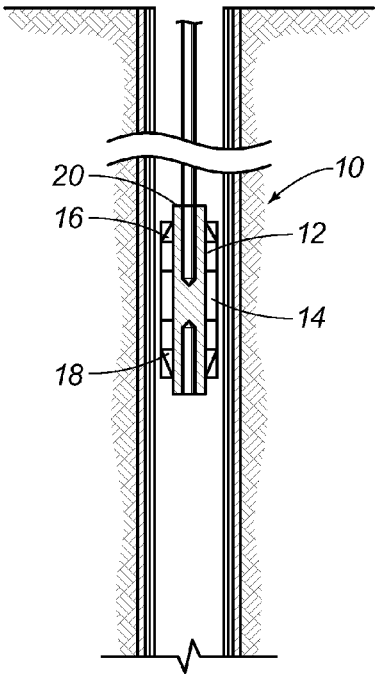
FIG. 1A Prior Art
FIG. 1A is a schematic view of a prior art bridge plug system, being placed in a wellbore.
Figure 1B:
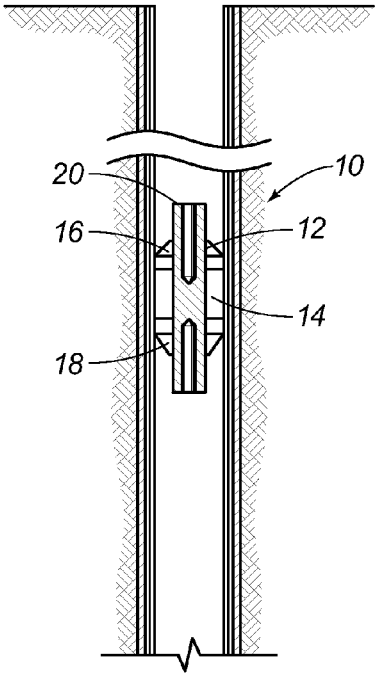
FIG. 1B Prior Art
FIG. 1B is another schematic view of the prior art bridge plug system, being locked in position within the wellbore.
Figure 2:
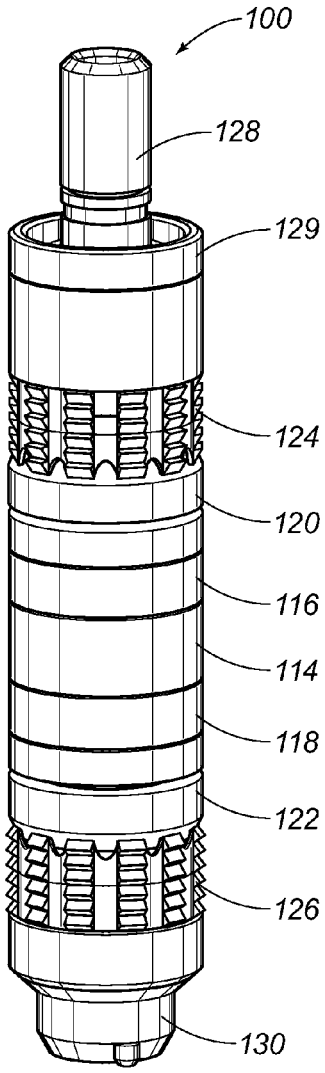
FIG. 2 is a perspective view of an embodiment of the bridge plug of the present invention.
Figure 3:
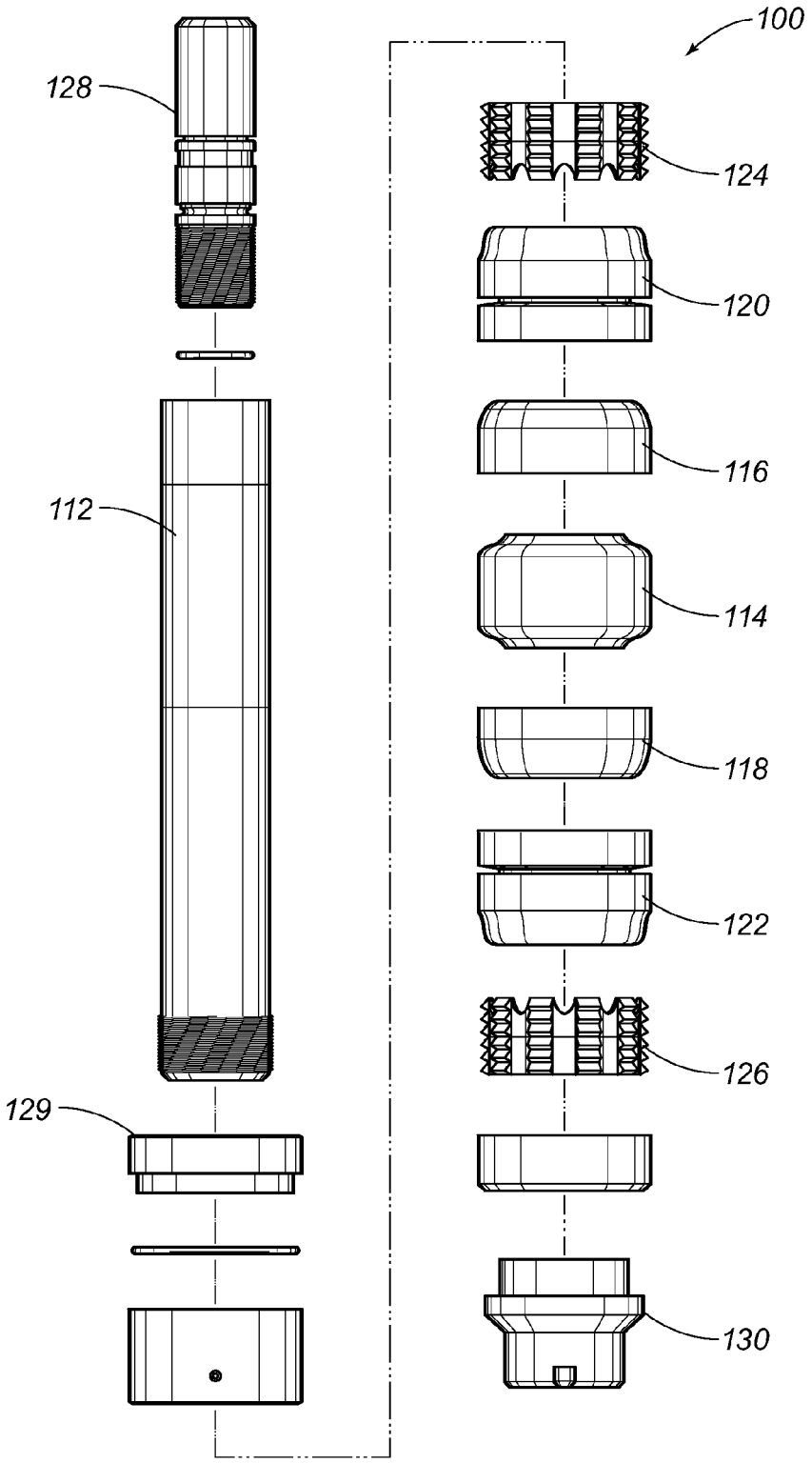
FIG. 3 is an exploded perspective view of the embodiment of FIG. 2.
Figure 6:
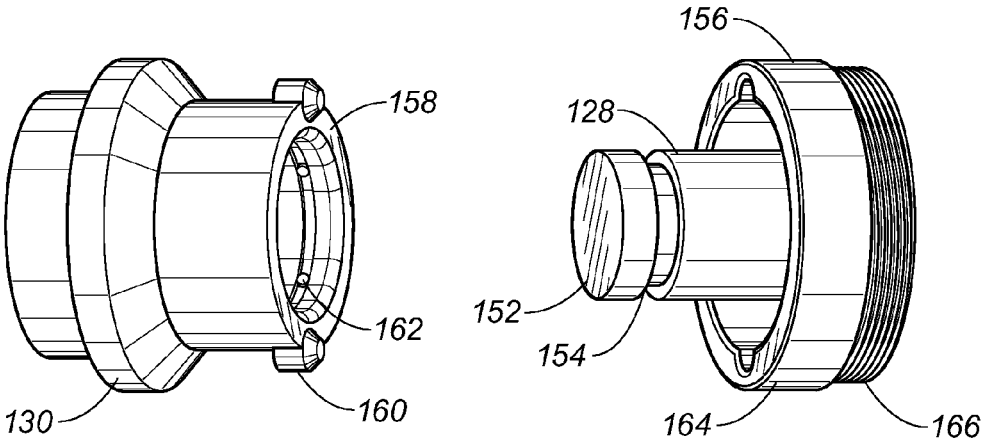
FIG. 6 is a perspective view of a shearing means and a cap means of an embodiment of a bridge plug of the present invention.

FIG. 6 shows a detailed perspective view of the shearing means 128 and the cap means 130 of an embodiment of the millable bridge plug system 100. The shearing means 128 is attached to an upper portion of the mandrel 112 in FIGS. 2-5. The positioning assembly with the setting tool handles the system 100 by the mandrel 112 for placement in the wellbore. The pressure from the ramming portion of the setting tool sets and locks the bridge plug system 100. When the correct location is reached and the wellbore is sealed, the shearing means 128 is separated from the setting tool on the positioning assembly. The setting tool shears the shaft member 152 to break the bridge plug system 100 from the positioning assembly. FIG. 6 shows the shearing means 128 as a generally solid tubular member as the shaft member 152 with a locking groove 154. The locking groove 154 has a diameter smaller than the shaft member 152 of the shearing means 128. The shearing means 128 is formed by a millable material so that the system 100 can be removed. In one embodiment, the shearing means 128 further includes a top locking ring 156, wherein the shaft member 152 is fixedly engaged within the top locking ring 156 as shown in FIGS. 2 and 4.

Figure 7:
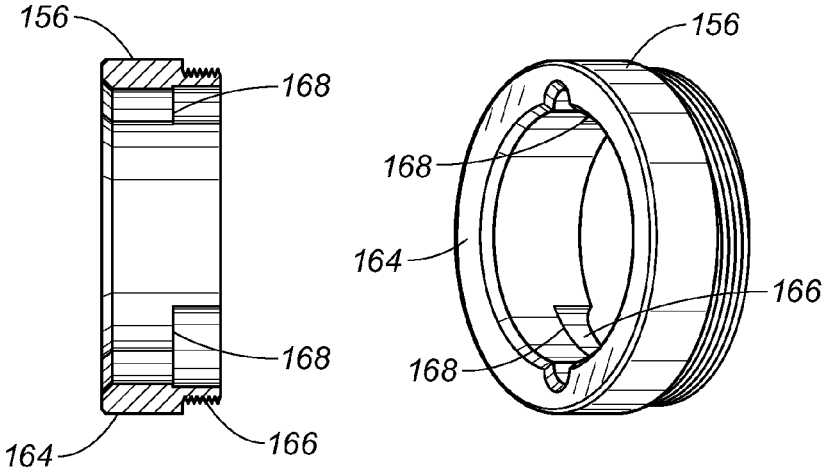
FIG. 7 is a cross-sectional view and perspective view of a top locking ring of a shearing means of the embodiment of FIG. 6.

FIG. 6 also shows an embodiment of the cap means 130 with a bottom locking ring 158 having at least two protrusions 160 extending outwardly. There is also a groove locking means 162 within an interior of the bottom locking ring 158. In the embodiment shown in FIGS. 6-8, the top locking ring 156 comprises an outer housing 164 shaped to engage the bottom locking ring 158 and the protrusions 160 in a particular orientation, and an inner housing 166 adjacent the outer housing 164. The bottom locking ring 158 and the protrusions 160 are rotatable within the inner housing 166, after the protrusions 160 pass through the outer housing 164 in the particular orientation. The number of protrusions 160 is variable, and the compatible shape of the top locking ring 156 is similarly variable; however, the bottom locking ring 158 and protrusions 160 must remain able to be aligned on the shaft member 152 and aligned with a shape of the top locking ring 156. The bottom locking ring 158 and protrusions 160 must be insertable through the outer housing 164 and into the inner housing 166 of the top locking ring 156. From FIG. 7, once the protrusions 160 pass through the outer housing 164, the bottom locking ring 158 can be rotated, so that the protrusions 160 are no longer aligned with the outer housing 164. As such, the outer housing 164 forms a locking shoulder 168 to prevent release of the bottom locking ring 158 and the protrusions 160 from the top locking ring 156. Different orientation of the protrusions 160 lock the cap means 130 into the shearing means 128. The locking of the present invention is not threaded engagement, which may loosen during the milling process. The friction-fit engagement of the protrusions 160 on the locking shoulder 168 is one embodiment, and other mechanical locking structures may be covered by the present invention. A snap-fit or other rotational lock may also be covered by the claims of the present invention.

The cap means 130 and the shearing means 128 are modular ends of the bridge plug system 100. A cap means of an adjacent bridge plug is insertable over the shaft member 152 and into the top locking ring 156, so as to lock the adjacent bridge plug to the shearing means 128. It also follows that the cap means 130 can be inserted over a shaft member and into a top locking ring of an adjacent bridge plug, so as to lock the adjacent bridge plug to the cap means 130.

In another embodiment of the alignment and locking of the cap means 130 and shearing means 128, the shaft member 152 has a locking groove 154 and the cap means 130 comprises a groove locking means 162. In one embodiment, the groove locking means 162 is a spring loaded piston within an interior of the cap means 130. The piston can be triggered by the release of the compression of the spring to extend inward of the bottom locking ring 158. Other spring loaded mechanisms can be used to tighten around the interior of the cap means 130.

Figure 8:
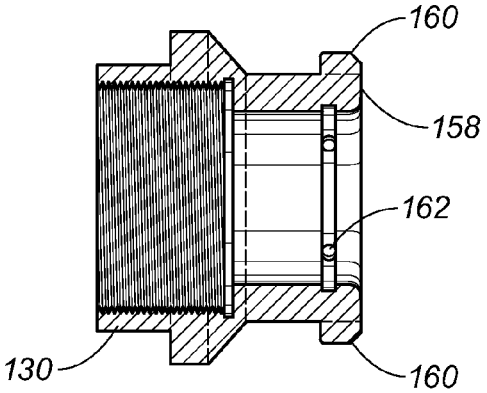
FIG. 8 is a cross-sectional view of a cap means of the embodiment of FIG. 6.

In FIGS. 6 and 8, the shaft member 152 is inserted into the cap means 130, wherein the groove locking means 162 is aligned with the locking groove 154. Once aligned, the groove locking means 162 engages the locking groove 154 so as to hold the cap means 130 on the shaft member 152. The locking groove 154 and groove locking means 162 are an alternative locking means on the modular ends of the system 100. The locking groove 154 and the groove locking means 162 may also be used in addition to the top locking ring 156 and the bottom locking ring 158 with protrusions 160.

The use of two mechanical systems with two different locks improves the consistency and strength of the connection between bridge plugs. The locking groove 154 and groove locking means 162 is not based on rotation to friction-fit the locking rings 156 and 158, so that the system 100 is more resilient to rotational forces in the milling process. Similar to the modular properties of the locking rings 156 and 158, a cap means of an adjacent bridge plug is insertable over the shaft member 152 with locking groove 154, so as to lock the adjacent bridge plug to the shearing means 128; and the cap means 130 is inserted over a shaft member of an adjacent bridge plug, so as to trigger the groove locking means 162 for locking the adjacent bridge plug to the cap means 130. The shearing means of the adjacent bridge plug is identical to the shearing means 128 of the system 100. The system 100, including the shearing means 128 and the cap means 130 is modular, so that the system 100 is identical and compatible with other systems. The terminology of the modular bridge plug system may include primary and secondary bridge plugs, which are adjacent to each other. Facing end to end, the primary and secondary bridge plugs can be locked together.

The method of connecting two bridge plugs, according to an embodiment of the present invention, includes aligning a primary bridge plug and a secondary bridge plug. In one example, the secondary bridge plug is positioned below the primary bridge plug. Being modular, the method will also work with the primary bridge plug below the secondary bridge plug. In whichever alignment, the secondary shearing means is inserted and locked into the primary cap means or the primary shearing means is inserted and locked into the secondary cap means.

The millable bridge plug system of the embodiments of the present invention has modular ends. The ends interchangeably connect with adjacent bridge plugs so that multiple bridge plugs can be connected together. As a single unit, the connected bridge plugs rotate together or remain still together because of the locking connections. The locking connection is a mechanical lock, unlike threaded engagement, which may be disengaged by rotation or counter rotation. The locking connection is also different from slot alignment, wherein a shearing means is fitted into a slot on a cap means. The slot aligns the bridge plugs and can match rotation of adjacent bridge plugs, but there is no lock. Bridge plugs may separate from each other to lose the connection and matched rotation. By connecting bridge plugs, the process of removal is easier.

In one by one removal, each milled bridge plug stays in place without rotation until the lower slip is milled. Then, the lower portions of the bridge plug become partial remnants that may interfere with milling another bridge plug further into the borehole. Undrilled portions or remnants of previously removed bridge plugs rotate at different rates on the removal assembly as debris, until the remnants are pressed and milled against the next bridge plug down the borehole. Then, the removal assembly can drill through the remnants against the slips and sealing member of this next bridge plug. In embodiments of the present invention, bridge plugs can be connected to each other. Even if after drilling through the slips and the sealing member, the remaining cap means is aligned and locked onto another bridge plug, which is stable due to having active slips and the seal means still engaged to the borehole. The cap means remnant is no longer interference debris that could stall or damage the removal assembly. The slips of one bridge plug can stabilize all of the connected bridge plugs so that all of the connected bridge plugs can be drilled out for removal. Alternatively, all of the connected bridge plugs can be collected to the bottom of the borehole and drilled out at once.

The foregoing disclosure and description of the invention is illustrative and explanatory thereof. Various changes in the details of the illustrated structures, construction and method can be made without departing from the true spirit of the invention.

I claim:

1. A millable bridge plug system comprising:

a mandrel having an upper portion and a lower portion;

a shearing means attached at said upper portion of said mandrel;

a sealing means positioned around the mandrel between said upper portion and said lower portion;

a plurality of ring members, a first ring member adjacent an upper end of said sealing means and a second ring member adjacent a lower end of said sealing means;

a plurality of cone assemblies, a first cone assembly proximate to said first ring member and a second cone assembly proximate to said second ring member, said first ring member being between said first cone assembly and said sealing means, said second ring member being between said second cone assembly and said sealing means;

a plurality of slip means for extending radially outward and engaging an inner surface of a surrounding borehole, a first slip means mounted around said mandrel and engaging said first cone assembly and a second slip means mounted around said mandrel and engaging said second cone assembly; and a cap means attached at said lower portion of said mandrel, wherein said shearing means comprises a shaft member and a top locking ring, said shaft member being fixedly engaged within said top locking ring, and wherein said cap means comprises a bottom locking ring.

2. The bridge plug system according to claim 1, said bottom locking ring having at least two protrusions extending outwardly.

3. The bridge plug system according to claim 2, wherein said top locking ring comprises:

an outer housing shaped to engage said bottom locking ring and the protrusions in a particular orientation; and an inner housing adjacent said outer housing, wherein bottom locking ring and the protrusions are rotatable within said inner housing, after the protrusions pass through said outer housing in said particular orientation.

4. The bridge plug system according to claim 3, wherein said outer housing forms a locking shoulder so as to prevent release of said bottom locking ring and the protrusions from said top locking ring when rotated in a different orientation.

5. The bridge plug system according to claim 1, wherein a cap means of an adjacent bridge plug is insertable over said shaft member and into said top locking ring, so as to lock the adjacent bridge plug to said shearing means.

6. The bridge plug system according to claim 1, wherein said cap means is inserted over a shaft member and into a top locking ring of an adjacent bridge plug, so as to lock the adjacent bridge plug to said cap means.

7. The bridge plug system according to claim 1, wherein said shaft member has a locking groove.

8. The bridge plug system according to claim 7, wherein said cap means comprises a groove locking means.

9. The bridge plug system according to claim 8, said groove locking means being a spring loaded piston within an interior of said cap means.

10. The bridge plug system according to claim 8, wherein said shaft member is insertable into said cap means, wherein said groove locking means is aligned with said locking groove, and wherein said groove locking means engages said locking groove so as to hold said cap means on said shaft member.

11. The bridge plug system according to claim 10, wherein a cap means of an adjacent bridge plug is insertable over said shaft member, so as to lock the adjacent bridge plug to said shearing means.

12. The bridge plug system according to claim 10, wherein said cap means is inserted over a shaft member of an adjacent bridge plug, so as to lock the adjacent bridge plug to said cap means.

13. A millable bridge plug system comprising:

a mandrel having an upper portion and a lower portion;

a shearing means attached at said upper portion of said mandrel, wherein said shearing means comprises a shaft member and a top locking ring, said shaft member being fixedly engaged within said top locking ring and having a locking groove;

a sealing means positioned around the mandrel between said upper portion and said lower portion;

a plurality of ring members, a first ring member adjacent an upper end of said sealing means and a second ring member adjacent a lower end of said sealing means;

a plurality of cone assemblies, a first cone assembly proximate to said first ring member and a second cone assembly proximate to said second ring member, said first ring member being between said first cone assembly and said sealing means, said second ring member being between said second cone assembly and said sealing means;

a plurality of slip means for extending radially outward and engaging an inner surface of a surrounding borehole, a first slip means mounted around said mandrel and engaging said first cone assembly and a second slip means mounted around said mandrel and engaging said second cone assembly; and a cap means attached at said lower portion of said mandrel and being comprised of a bottom locking ring with at least two protrusions extending outwardly and a groove locking means.

14. A method of connecting two bridge plugs, the method comprising:

aligning a primary bridge plug and a secondary bridge plug, said secondary bridge plug being positioned below said primary bridge plug, said primary bridge plug comprising:

a primary mandrel having an upper portion and a lower portion;

a primary shearing means attached at said upper portion of said primary mandrel; and a primary cap means attached at said lower portion of said primary mandrel; and said secondary bridge plug comprising:

a secondary mandrel having an upper portion and a lower portion;

a secondary shearing means attached at said upper portion of said secondary mandrel; and a secondary cap means attached at said lower portion of said secondary mandrel; and locking said secondary shearing means into said primary cap means.

15. The method of connecting two bridge plugs according to claim 14, wherein said primary shearing means comprises a primary shaft member and a primary top locking ring, said primary shaft member being fixedly engaged within said primary top locking ring, wherein said secondary cap means comprises a secondary bottom locking ring, said secondary bottom locking ring having at least two protrusions extending outwardly, and wherein said primary top locking ring comprises an outer housing and an inner housing adjacent said outer housing, the step of aligning further comprising:

orienting said secondary bottom locking ring and the protrusions to pass through said primary top locking ring to said inner housing.

16. The method of connecting two bridge plugs according to claim 15, the step locking further comprising:

rotating said secondary bottom locking ring and the protrusions within said inner housing, said primary outer housing forming a locking shoulder so as to prevent release of said secondary bottom locking ring and the protrusions from said primary top locking ring when rotated in a different orientation.

17. The method of connecting two bridge plugs according to claim 14, wherein said primary shaft member has a locking groove, and wherein said secondary cap means comprises a groove locking means, the step of aligning further comprising:

inserting said primary shaft member into said second secondary cap means, said locking groove being adjacent to said groove locking means.

18. The method of connecting two bridge plugs according to claim 17, the step of locking further comprising:

triggering said groove locking means to fixedly engage said locking groove.

* * * * *